US005723187A

United States Patent [19]

Popoola et al.

[11] Patent Number: 5,723,187

[45] Date of Patent: Mar. 3, 1998

[54] METHOD OF BONDING THERMALLY SPRAYED COATING TO NON-ROUGHENED ALUMINUM SURFACES

[75] Inventors: Oludele O. Popoola, Grand Blanc; Matthew J. Zaluzec, Canton; Armando M. Joaquin, Rochester Hills; James R. Baughman, Plymouth; David J. Cook, Farmington Hills, all of Mich.

[73] Assignee: Ford Global Technologies, Inc., Dearborn, Mich.

[21] Appl. No.: 669,262

[22] Filed: Jun. 21, 1996

[51] Int. Cl.[6] ..... C23C 4/06; C23C 4/02

[52] U.S. Cl. ..... 427/453; 427/454; 427/455; 427/456; 427/310

[58] Field of Search ..... 427/456, 310, 427/453, 454, 455

[56] References Cited

U.S. PATENT DOCUMENTS

| | | | |
|---|---|---|---|
| 2,569,097 | 9/1951 | Grange et al. . | |
| 2,654,701 | 10/1953 | Calderon et al. . | |
| 2,671,737 | 3/1954 | Jominy et al. . | |
| 2,756,497 | 7/1956 | Gale | 427/310 |
| 2,785,084 | 3/1957 | Lundin et al. . | |
| 2,958,610 | 11/1960 | Ramirez et al. . | |
| 3,000,755 | 9/1961 | Hanink et al. | 427/310 |
| 3,155,536 | 11/1964 | Freeman, Jr. et al. | 427/310 |
| 3,667,111 | 6/1972 | Chartet | 29/495 |
| 3,982,055 | 9/1976 | Howard | 427/309 |
| 4,087,367 | 5/1978 | Rioult et al. | 427/309 |
| 4,911,351 | 3/1990 | Ishikawa et al. | 228/183 |
| 5,100,486 | 3/1992 | Kirkorian et al. | 427/310 |
| 5,271,804 | 12/1993 | Muller et al. | 156/665 |
| 5,271,967 | 12/1993 | Kramer et al. | 427/456 |
| 5,380,564 | 1/1995 | Vankuiken, Jr. et al. | 427/456 |

OTHER PUBLICATIONS

"Reaction Chemistry and Thermodynamics of the Ni–Al and Fe–Al Systems" Mat. Res. Soc. Symp. Proc. vol. 81, 1987 Materials Research Society (no month date).

*Primary Examiner*—Katherine A. Bareford
*Attorney, Agent, or Firm*—Joseph W. Malleck

[57] ABSTRACT

A method of bonding a thermally sprayed coating to a non-roughened light metal (i.e. cast aluminum-based) surface. The method comprises the steps of (a) depositing a flux material (i.e. potassium aluminum's fluoride containing up to 50 molar % other fluoride salts) onto such cast surface which has been cleansed to be substantially free of grease and oils, such deposition providing a dry flux coated surface, the flux being capable of removing oxide on the cast surface and having a melting temperature below that of the cast surface; (b) thermally activating the flux in the flux coated surface to melt and dissolve any oxide residing on the cast surface; and (c) concurrently therewith or subsequent to step (b) thermally spraying metallic droplets or particles onto the flux coated surface to form a metallic coating that is metallurgically bonded to the cast surface.

17 Claims, 4 Drawing Sheets

METHOD OF BONDING THERMALLY SPRAYED COATING TO NON-ROUGHENED ALUMINUM SURFACES

BACKGROUND OF THE INVENTION

1. Technical Field

This invention relates to the technology of bonding metals to aluminum substrates, and more particularly to processes that place stable fluxes onto such substrates to dissolve surface oxides and promote a strong metallurgical/chemical bond with sprayed metals.

2. Discussion of the Prior Art

Roughening has heretofore been the principal means of bonding thermal spray coatings to a cast aluminum surface. Such roughening has been carried out by mechanical means such as grit blasting, high pressure water, electric discharge machining or chemical etchants. Such techniques have proved disadvantageous either because of cost or because they are too disruptive of the substrate or the environment. It would be desirable if a method could be found that eliminated the need for roughening of cast aluminum substrates and yet enable the adherence of metallic coatings thereon.

Aluminum and aluminum alloys are generally very reactive and readily form intermetallic alloys with nickel, titanium, copper and iron at moderate temperatures. To offset such reactivity, aluminum or aluminum alloys form a passivating surface oxide film (5–100 nanometers thick) when exposed to the atmosphere at ambient temperatures. Such oxide film inhibits adherence of metals to unroughened aluminum. Thus, to effect a metallurgical, chemical or intermetallic bond between the aluminum or aluminum alloy and other metals, it is often necessary to remove, dissolve or disrupt such oxide film. When so striped of the oxide, aluminum or an aluminum alloy will readily alloy bond at temperatures as low as 500° C.

Fluxes are readily used to remove such film. This is exemplified by the current commercial practice of brazing two pieces of aluminum alloy sheet metal (usually cold-rolled with a low temperature brazing metal layer) which are joined by first assembling the pieces in a jointed relationship and then flooding the joint area with a flux applied at room temperature. When heated aggressively, the flux melts and strips the surface oxides, thereby allowing the layer to form an interfacial alloy joint with the aluminum(see U.S. Pat. No. 4,911,351). The flux composition often has a fluoride or chloride base (See U.S. Pat. No. 3,667,111); alkaloid aluminum fluoride or chloride salts have a melting temperature essentially at or just below the melting temperature of aluminum. This has proved very effective when working with rolled aluminum sheet, but will not work with cast aluminum alloys because cast aluminum is porous, non-homogenous, has no clad layer and melts at a lower temperature that overlaps the melting temperature of such fluxes. This is a significant drawback when (i) the metal that is to be bonded to the cast metal is a thermally sprayed metal, that is not the same as the cast metal, and (ii) the metal is applied as hot droplets without the presence of a low melting braze metal.

Therefore, the primary object of this invention is to achieve a method that economically, reliably and instantly bonds thermally sprayed metallic droplets or particles onto an unroughened cast light metal based substrate without the presence of conventional braze material. The method should provide a metallurgical and/or chemical bond between such light metal and thermally sprayed metallic coatings as opposed to mechanical interlocking achieved by the prior art.

SUMMARY OF THE INVENTION

The invention herein that meets the above object is a method that bonds a thermally sprayed coating to a non-roughened cast light metal (i.e. aluminum-based) surface with the qualities desired. The method comprises (a) depositing a flux material onto a cast light metal based surface cleansed to be substantially free of grease and oils, such deposition providing a dry flux coated surface, the flux being capable of removing an oxide of the light metal and having a melting temperature below that of the light metal based surface; (b) thermally activating the flux on the flux coated surface to melt and dissolve any oxide residing on the light metal based surface; and (c) concurrently therewith or subsequent to step (b) thermally spraying metallic droplets or particles onto the flux coated surface to form a metallic coating that is at least metallurgically bonded to the aluminum based surface.

Advantageously for aluminum based substrates, the flux is a eutectic of potassium aluminum fluoride containing up to 50 molar % of other fluoride salts, the flux being preferably applied as a solution utilizing water or alcohol solvents; the particle size of the fluoride salts is preferably controlled to less than 10 micrometers, with at least 70% of such salts being in the particle size range of 2–4 micrometers resulting in 20–30%, by volume, of the particles remaining in suspension at all times without stirring.

DETAILED DESCRIPTION AND BEST MODE

Figure 1:
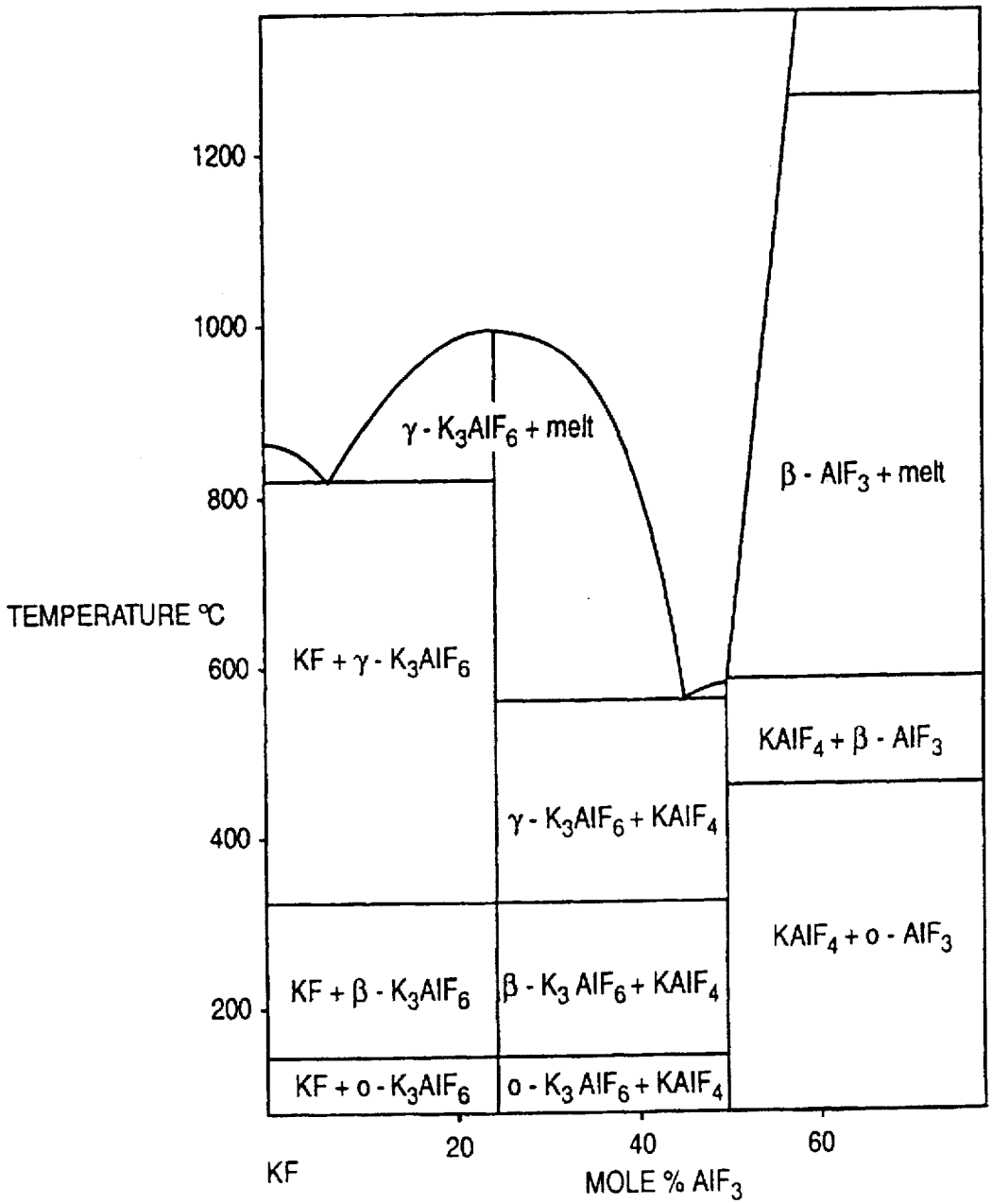
FIG. 1 is a temperature-phase diagram of potassium aluminum fluoride salts as a function of the molar percent of $AlF_3$.

Experience with fluoroaluminum fluxes has usually been with pressed aluminum sheet alloy material having a melting temperature in the range of 640°–660° C. This invention is preferably concerned with successfully fluxing cast aluminum alloys (such as 319, 356, 380 and 390) that contain Si, Cu, Mn or Fe ingredients in amounts ranging from 0.5–5% (by weight) and thus possess a slightly lower melting temperature (of about 580°–600° C.) when compared with the pressed aluminum sheet alloys, such as the 3000 series containing 0.5–1.5% of Mn, Mg, and Fe ingredients. The surface roughness of such cast alloys is usually about 1–3 micrometers $R_a$ which is insufficient by itself to provide a mechanical interlock with thermally sprayed coatings thereover.

After the cast component is formed of a light metal, Al, Mg, such as a cast aluminum engine block 10 having a plurality of cylindrical bores 11 possessing an interior surface 12 with a roughness of about 0.5–2 μm, and after such surfaces have been cleansed of any grease or oil, essentially three steps are employed. First, a flux material having a melting temperature well below the melting temperature of the cast aluminum alloy (i.e. about 60°–80° C. below) is deposited thereon and dried. Next, the flux is thermally activated to effect dissolution of any aluminum oxide film on the cylinder bore surface. Lastly, metal droplets or particles are thermally sprayed onto the activated fluxed surface to form a metallic coating that is at least metallurgically bonded to the aluminum oxide-free surface.

As shown in FIG. 1, the flux is selected preferably to be eutectic 13 comprising a double fluoride salt having the phase formula γ. $K_3AlF_6$+$KAlF_4$. Such eutectic contains $AlF_3$ at about 45 mole percent of the double fluoride salt, with KF being about 55 mole percent. The eutectic has a melting temperature of about 560° C. (along line 14) which is about 40° C. below that of the cast alloy of the substrate. If the double fluoride salt has a substantially different molar percentage of $AlF_3$ (thus not being a eutectic) the melting temperature will rapidly rise along line 15 of FIG. 1. Other double fluoride salts, and for that matter other alkaline metal fluoride or chloride salts, can be used as long as they have a melting temperature that can be heat activated without disturbing the cast aluminum alloy. Chloride salts are useful, but undesirable because they fail to provide corrosion resistance on the aluminum product, and may attack aluminum alloy grain boundaries.

To deposit the flux, the salt is dissolved or suspended in a sprayable medium, such as water or alcohol, in a concentration of about 0.5–5.0% by volume or a minimum of 5 grams per square meter of flux. The solution may contain a mild alkaline wash, such as the commercial chemical product 5896, permitting the flux to spread more uniformly by reducing surface tension. The solution may also contain other additional ingredients, up to 50 wt. % such as LiF, or CsF which facilitate working with other substrates such as magnesium containing magnesium oxide films.

The double fluoride salt is added to the sprayable medium in closely controlled particle size to minimize the need for stirring and to retain as least 25 percent by volume of the salt in suspension at all times. To this end, the salt particle size is equal to or less than 10 microns with about 70% being 2–4 microns. The salt is spray deposited in a density of about 3–7 grams per square meter (preferably about 5 grams per square meter); too much salt will inhibit flux melting and two little will fail to achieve the fluxing effect.

Figure 2:
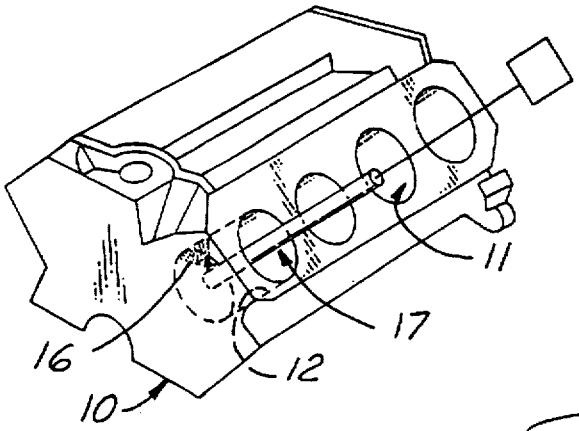
FIG. 2 is a schematic perspective of a flux spraying apparatus used to coat the interior of the aluminum engine block cylinder bore with the flux material.

Deposition is carried out preferably by use of a liquid spray gun 17 (see FIG. 2) which simultaneously rotates and moves axially up and down the cylinder bore while applying the flux solution to achieve the desired coverage and coating uniformity. After deposition, the flux is dried preferably by placing the flux coated substrate in a dehumidifier and removing the solvent; this leaves a fine talc-like powder on the substrate.

Thermal activation of the flux (to its eutectic melting temperature, i.e. 500°–580° C.) can optimally be brought about by the instantaneous transfer of heat from impact of the thermally sprayed metallic droplets or particles (which are at a temperatures above 1000° C.) onto the flux coated surface, or alternatively may be thermally activated by independent means such as flame, resistance or induction devices.

Figure 3:
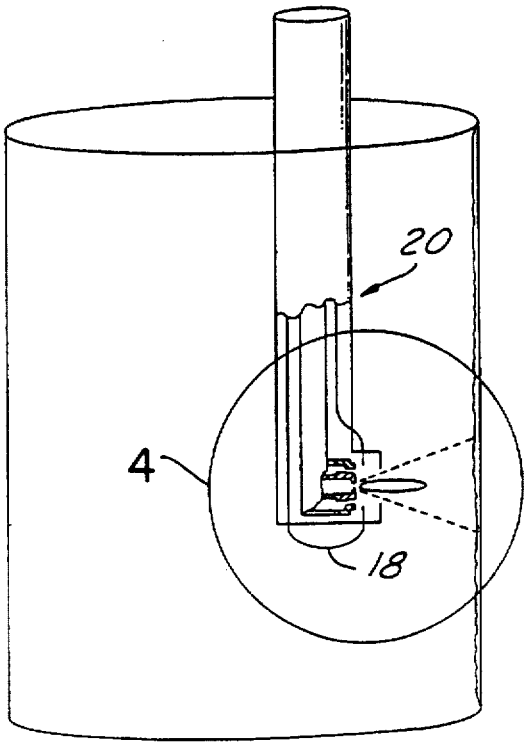
FIG. 3 is a schematic perspective view of a thermal spray apparatus used to apply the metal droplets or particles to the interior surface of a cast aluminum engine block bore surface.
Figure 4:
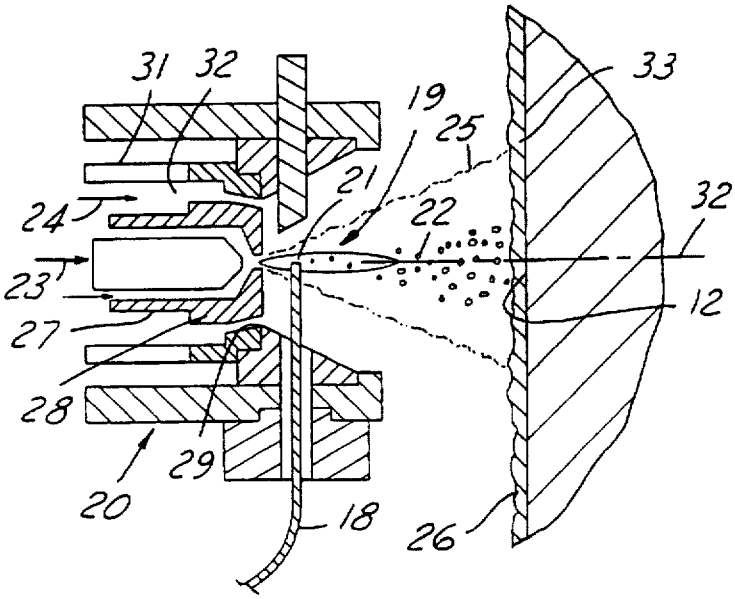
FIG. 4 is a highly enlarged sectional view of a portion of the spray gun and immediate coated surface.

Thermal spraying of metallic droplets or particles can be carried out by use of an apparatus as shown in FIGS. 3 & 4. A metallic wire feedstock 18 is fed into the plasma or flame 19 of a thermal gun 20 such that the tip 21 of the feedstock 18 melts and is atomized into droplets 22 by high velocity gas jets 23 and 24. The gas jets project a spray 25 onto a light metal cylinder bore wall 12 of an engine block and thereby deposit a coating 26. The gun 20 may be comprised of an inner nozzle 27 which focuses a heat source, such as a flame or plasma plume 19. The plasma plume 19 is generated by striping of electrons from the primary gas 23 as it passes between the anode 28 and cathode 29 resulting in a highly heated ionic discharge or plume 19. The heat source melts the wire tip 21 and the resulting droplets 22 are carried by the primary gas 23 at great velocity to the target. A pressurized secondary gas 24 maybe use to further control the spray pattern 25. Such secondary gas is introduced through channels 30 formed between the cathode 29 and a housing 31. The secondary gas 24 is directed radially inwardly with respect to the axis 32 of the plume. Melting of the wire 18 is made possible by connecting the wire as an anode when striking an arc with cathode 29. The resulting coating 26 will be constituted of splat layers or particles 33. While the use of wire feedstock is described in detail herein, powder fed thermal spray devices could be used to produce the same bonding effect.

The heat content of the splat particles as they contact the coated aluminum substrate is high, i.e. about 1200°–2000° C. This heat content instantaneously activates the flux to dissolve any oxide on the substrate and promote a metallurgical bond with the thermally sprayed particle thereover. To further facilitate the metallurgical bond between the oxide free aluminum substrate and the thermally sprayed particles, a bond coat may be initially thermally sprayed thereonto consisting of nickel-aluminum or bronze-aluminum; preferably the bond coat has a particle size of 2.5–8 μm which causes the coated surface to have a surface finish of about 6 μm Ra. A final top coating of a low carbon alloy steel or preferably a composite of steel and FeO is provided. If a composite top coating is desired, the wire feedstock is comprised of a low carbon low alloy steel and the secondary gas is controlled to permit oxygen to react with the droplets 22 to oxidize and form the selective iron oxide $Fe_xO$ (Wuestite, a hard wear resistance oxide phase having a self lubricating property). The composite coating thus can act very much like cast iron that includes graphite as an inherent self lubricant. The gas component containing the oxygen can vary between 100% air (or oxygen) and 100% inert gas (such as argon or nitrogen) with corresponding degrees of oxygenation of the Fe. The secondary gas flow rate should be in the range of 30–120 standard cubic feet per minute to ensure enveloping all of the droplets with the oxidizing element and to control the exposure of the steel droplets to such gas.

Figure 5:
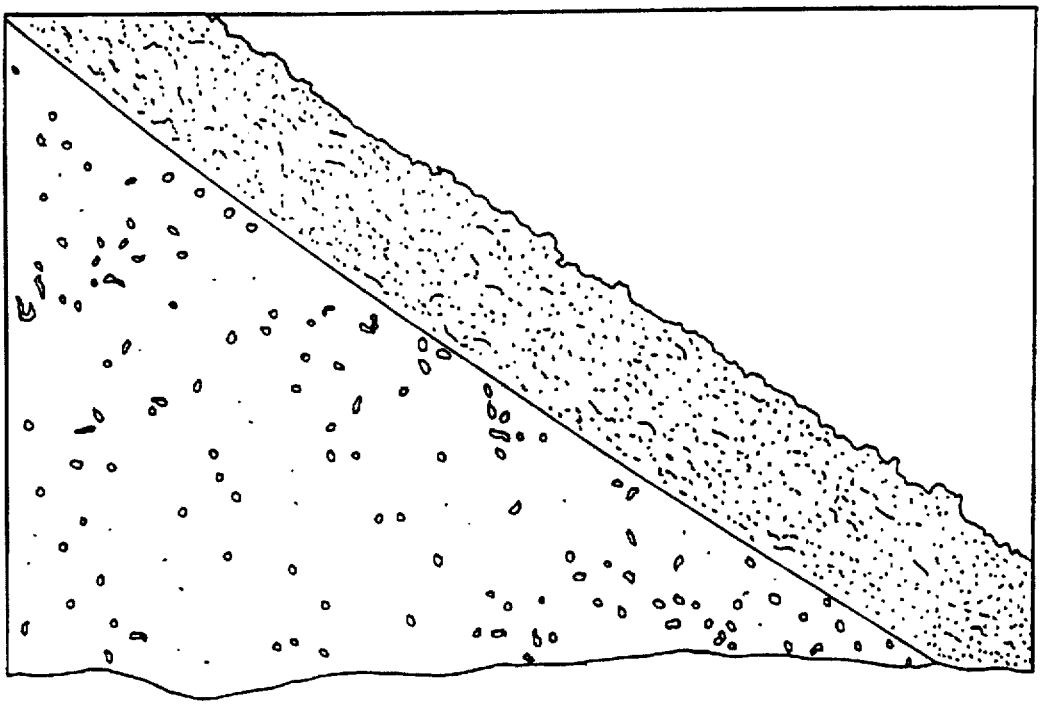
FIG. 5 is a microphotograph (100× magnification) of the coated cast aluminum surface processed in accordance with this invention.

FIG. 5 shows a scanning electron micrograph for a substrate 40 that has been coated in accordance with this invention. The interface 41 is straight with no apparent interlocking areas between the coating 42 and the substrate 40. While we do not wish to be bound by any theoretical reason, the bonding achieved in this invention can be attributed to intermetallic alloy formation and/or pairing of oxygen atoms located at the hot droplets surfaces with the oxide free aluminum surface.

Figure 6:
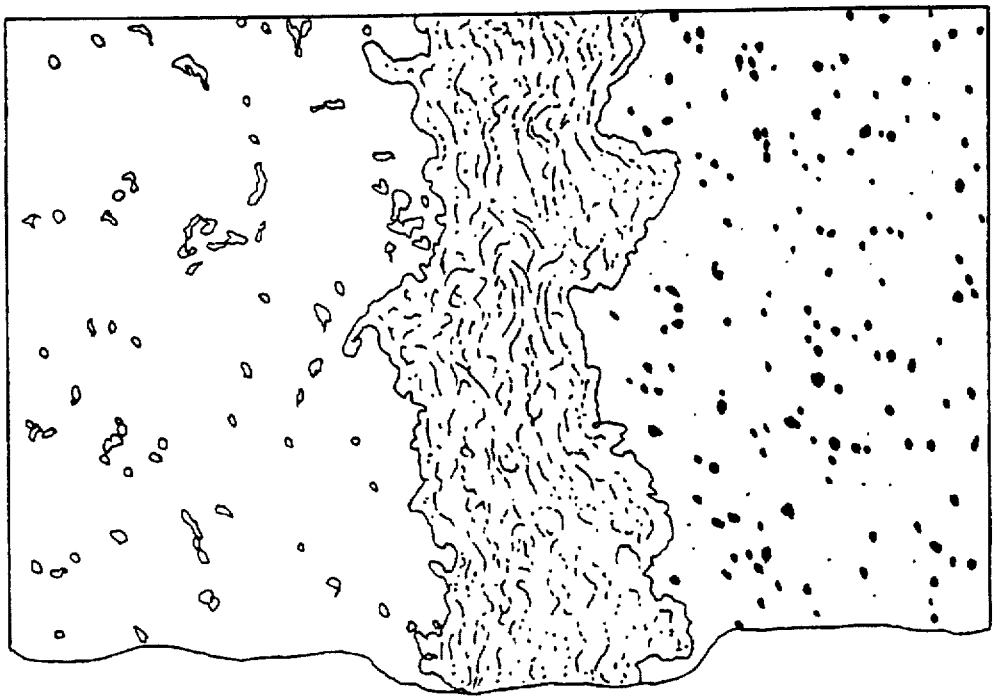
FIG. 6 is a microphotograph (85× magnification) of a cast aluminum surface prepared by use of a roughening technique (water jetting) and then coated by thermal spraying of metallic particles over such roughened surface.
Figure 7:
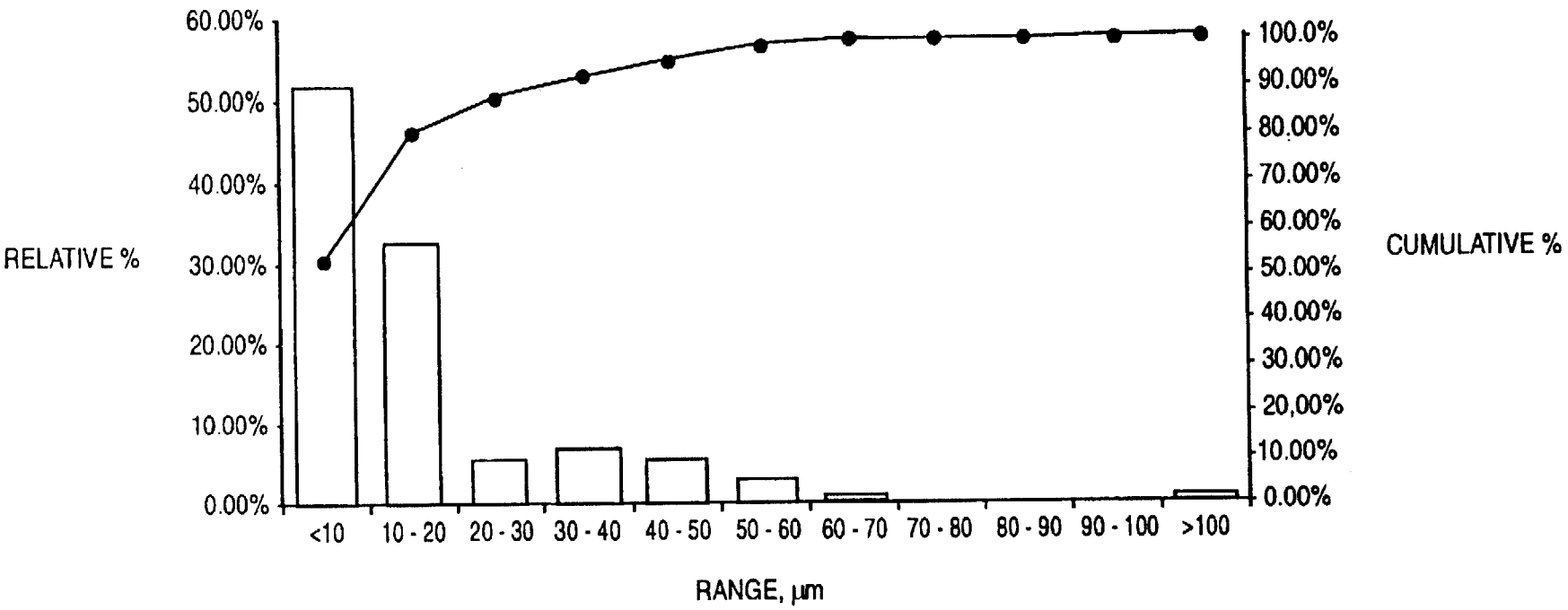
FIG. 7 is a graphical illustration of the particle size distribution of the metallic droplets or particles presented in the coating of FIG. 5.

FIG. 6 illustrates and compares the interfacial morphology produced when using various processes that involve roughening techniques. Note the apparent roughness and irregularity of the coated surface 43 on such a rougher substrate 44, thereby requiring a greater thickness 45 to be eventually honed to a smooth uniform flat surface 46. The use of smaller diameter wire feedstock in the thermal spray step can produce lower average surface roughness (Ra) in the final top coating to less than 5 microns. The droplet or particle size distribution of the spray for either the bond coat or top coat is shown in FIG. 7.

It was found that practicing the method of this invention reduces the cycle time for the total of the three basic steps to one minute or less. The coatings, when applied in accordance with this invention, were found to adhere to an aluminum substrate (such as 319) with an average interfacial bond strength of 3200–6000 psi. It should be mentioned that once the flux melts and dissolves the surface oxide layer, it undergoes a phase transformation upon cooling that prevents reoxidation of the aluminum surface.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. Method of bonding a thermally sprayed coating to a non-roughened cast light-metal surface, comprising;

(a) with a non-roughened cast light-metal surface substantially devoid of grease and oils, depositing a flux material thereonto to provide a dry flux coated surface, said flux being capable of removing oxides of said light metal and having a melting temperature of 60°–80° C. below that of the light-metal surface;

(b) thermally activating said flux of said flux coated surface to melt and dissolve any light-metal oxide residing on the light-metal surface; and (c) concurrently therewith or subsequent to step (b) thermally spraying metallic droplets or particles onto said flux coated surface to form a metallic coating that is at least metallurgically bonded to the light-metal surface.

2. The method as in claim 1, in which said flux is comprised of a potassium aluminum fluoride and containing less than 50 molar percent of other ingredients.

3. The method as in claim 1, in which said flux is applied as a solution sprayed onto the light metal surface, said solution having a water or alcohol solvent base.

4. The method as in claim 3, in which said flux is comprised essentially of potassium aluminum fluoride salt having a particle size less than 10 microns and having about 20% of such particles of a size between 2–4 microns, causing 20–30% by volume of said particles to remain in suspension in the solution at all times without stirring.

5. The method as in claim 3, in which said solution is sprayed in a volume of 3–10 grams per $m^2$.

6. The method as in claim 3, in which said sprayed solution is dried after disposition to remove the solvent of said solution.

7. The method as in claim 2, in which said deposited flux is thermally activated at a temperature 500°–580° C.

8. The method as in claim 1, in which the heat of the thermally sprayed droplets or particles is transferred to the dry flux coating to concurrently heat activate the flux at the same time the thermal spray droplets or particles are being deposited on the light metal surface.

9. The method as in claim 1, in which at least an outer exposed coating of said metallic droplets or particles is constituted of steel based particles.

10. The method as in claim 9, in which said final coating is a composite of steel and FeO.

11. The method as in claim 9, in which said substrate is comprised of an aluminum base, and in which said thermal spraying comprises deposition of a bond coating of metallic droplets or particles applied prior to the deposition of final or outer exposed coat, said bond coating being nickel or bronze.

12. The method as in claim 11, in which the diameter of said droplets or particles of the thermal spray is controlled to a range of 14–20 microns for the bond coat and to about 5 microns for the final coating.

13. The method as in claim 1, in which total coating thickness resulting from step (c) is in the range of 50–500 micrometers.

14. The method as in claim 1, in which time for carrying out steps (a) through (c) is equal to or less than 1 minute.

15. The method as in claim 1, in which said deposited flux is thermally activated also by direct flame, resistance or induction heating.

16. A method of bonding a thermally sprayed coating to a non-roughened cast aluminum based surface, comprising;

(a) with such surface substantially devoid of grease and oils, depositing a flux comprised of a potassium aluminum fluoride thereonto to provide a dry flux coated surface that is activated at a temperature of 500°–580° C.;

(b) thermally spraying metallic droplets or particles in two stages, the first stage is carried out to thermally spray a bond coat which is effective to instantaneously thermally activate the flux upon contact with the flux coated surface to melt and dissolve any aluminum oxide residing on the aluminum based surface, and a second stage of thermally spraying is carried out to spray droplets or particles of a composite of low carbon steel and FeO to form a top coating; and (c) honing said top coat to a uniform surface finish of 0.1–1.0 μm and to a thickness of 50–500 micrometers.

17. The method as in claim 16, in which adhesive bond strength of said thermally sprayed coatings to said aluminum based substrate is in the range of 3000–4250 psi.

* * * * *